US007310883B1

(12) United States Patent
Park

(10) Patent No.: US 7,310,883 B1
(45) Date of Patent: Dec. 25, 2007

(54) SIZING SCHEME TO IMPROVE CLOTHING SIZE ACCURACY

(76) Inventor: Lee Ann Park, 5121 Isabella Dr., Palm Beach Gardens, FL (US) 33418

( * ) Notice: Subject to any disclaimer, the term of this patent is extended or adjusted under 35 U.S.C. 154(b) by 114 days.

(21) Appl. No.: 11/412,597

(22) Filed: Apr. 26, 2006

Related U.S. Application Data

(60) Provisional application No. 60/711,718, filed on Aug. 26, 2005.

(51) Int. Cl.
*G06G 1/00* (2006.01)

(52) U.S. Cl. ..... 33/1 C; 33/1 SB; 33/2 R; 33/512

(58) Field of Classification Search ..... 33/1 B, 33/1 C, 1 S, 1 AA, 1 SB, 2 R, 17 R, 512
See application file for complete search history.

(56) References Cited

U.S. PATENT DOCUMENTS 5,163,007 A * 11/1992 Slilaty ..... 700/132
5,619,804 A * 4/1997 Vogt et al. ..... 33/512
5,680,314 A * 10/1997 Patterson et al. ..... 700/132
5,930,769 A * 7/1999 Rose ..... 705/27
6,415,199 B1 * 7/2002 Liebermann ..... 33/512
6,978,549 B2 * 12/2005 Ellis ..... 33/1 C
7,092,782 B2 * 8/2006 Lee ..... 700/132
2006/0287877 A1 * 12/2006 Wannier et al. ..... 705/1

OTHER PUBLICATIONS

"Standard sizing gives clothing retailers fits" in The International Herald Tribune by Michael Barbaro on Mar. 31, 2006.*

* cited by examiner

*Primary Examiner*—Christopher W Fulton
(74) *Attorney, Agent, or Firm*—Kevin Roe

(57) ABSTRACT

Methods to implement a sizing scheme to better quantify and more accurately represent clothing sizes. One embodiment is a method of providing an article of clothing after receiving the size alphanumeric characters determined from a sizing chart. A second embodiment is a method of making a sizing scheme chart for clothing, such as dresses, suits, blouses, pants, pajamas, and other clothing. A third embodiment provides a sizing chart for clothing. Various embodiments of the invention can apply to the waist and hip measurements, waist and bust measurements, and neck and chest measurements.

20 Claims, 8 Drawing Sheets

SIZING SCHEME TO IMPROVE CLOTHING SIZE ACCURACY

CROSS-REFERENCE TO RELATED APPLICATIONS

This application claims priority from a U.S. provisional patent application Ser. No. 60/711,718, filed on Aug. 26, 2005, and entitled "Sizing Scheme to Improve Clothing Size Accuracy," which is hereby incorporated by reference.

BACKGROUND OF THE INVENTION

1. Field of the Invention

This invention relates generally to the field of clothing, and more specifically to a sizing scheme to provide a more quantified and more accurate method for sizing articles of clothing.

2. Description of the Prior Art

Inconsistent clothing sizes along with fixed body proportion sizing present many problems in choosing clothing that will properly fit. Most people actually have to try wearing the clothing in order to determine whether the clothing will truly fit them. This causes many returns and is especially inconvenient when ordering the clothing from a catalog.

Clothing sizes at present currently use one size number to indicate the size of the clothing, such as dresses or suits. However, people can have the same body size in one respect, but vary greatly in their proportions between waist and hips, bust and waist, and neck size and chest size. In this case, one clothing size number is not adequate to indicate whether the clothing will truly fit.

One common problem is that people vary in their waist size and hip size. Some people have large hips and large waists, but other people have large hips and smaller waists. It also makes it difficult to purchase clothing for someone else who is not physically available to wear the clothing as a test. This is also a problem for finding the correct waist size and bust size, and for finding the correct neck size and chest size, since people also vary in their waist size, bust size, neck size, and chest size.

A need exists for a more quantified and more accurate sizing scheme for clothing to handle human variability in various body measurements. What is also needed is a relatively simple and inexpensive sizing scheme that can be easily implemented.

SUMMARY OF THE INVENTION

The present invention provides a more quantified and more accurate sizing scheme for clothing to handle human variability in various body measurements. The invention also provides a relatively simple and inexpensive sizing scheme that can be easily implemented. Embodiments of the invention can be implemented in numerous ways. Three aspects of the invention are described below.

A first aspect of the invention is directed to a method of providing an article of clothing after receiving the size determined from a sizing chart. The method includes interpreting a first set having at least one alphanumeric character as the waist size measurement of the article of clothing, with a base hip size; interpreting a second set having at least one alphanumeric character as the step adjustment to the base hip size to determine the final hip size measurement of the article of clothing; and providing the article of clothing according to the waist size measurement and the final hip size of the article of clothing.

A second aspect of the invention is directed to a sizing chart for clothing. The sizing chart includes a first set having at least one alphanumeric character corresponding to a first dimensional size; a second set having at least one alphanumeric character corresponding to a second dimensional size; and an indication of a final size in proximity to the intersection of a first set having at least one alphanumeric character and a second set having at least one alphanumeric character.

A third aspect of the invention is directed to a method to quantify a size tag for clothing. The method includes a current size alphanumeric character followed by a separator and then a second set having at least one alphanumeric character indicating the step increase for the second measurement. For example, in one embodiment, a "10.1" is a size 10 in the waist followed by a one step size increase to the base hip size.

DETAILED DESCRIPTION OF THE PREFERRED EMBODIMENT

Figure 1:
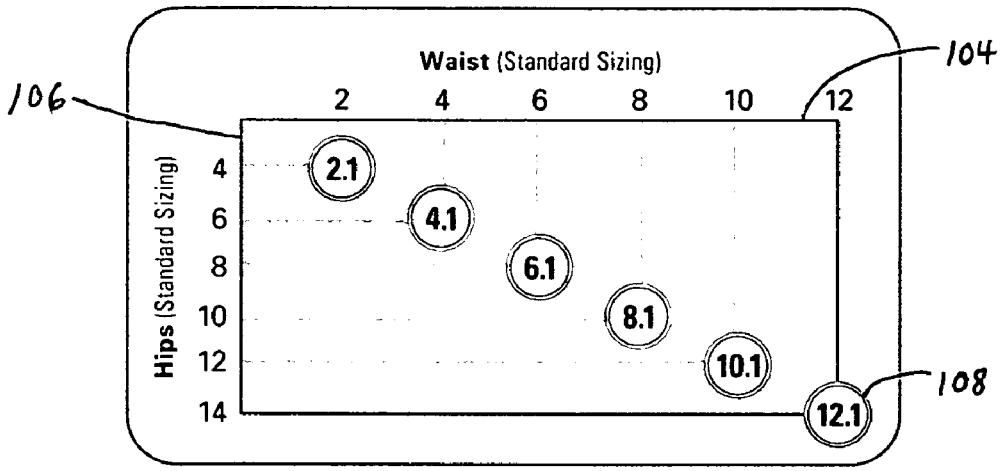
FIG. 1 illustrates a sizing chart for clothing with an increment to the next larger even number on the hip size, in accordance with one embodiment of the invention.

Embodiments of the invention can be constructed and implemented using off-the-shelf components. In all of the embodiments disclosed below, different materials could be used for the sizing chart and size tags, including but not exclusively: various plastics, resins, papers, fabrics, and plant fibers. All of the embodiments disclosed below could be applied to various articles of clothing, such as dresses, suits, blouses, pants, coats, pajamas, and equivalent garments.

In one embodiment of the invention, the sizing chart has the industry standard size numbers. In an alternative embodiment of the invention, the sizing chart has the sizes in inches. Each manufacturer varies in the waist and hip measurement, but it is almost standard that the two measurements (of the waist and hip) are 10 inches (i.e., 25.4 centimeters) different. In one embodiment of the invention, the two measurements (of the waist and hip) are 11 inches (i.e., 27.9 centimeters) different, with an increment of one inch. In an alternative embodiment of the invention, the two measurements (of the waist and hip) are 12 inches (i.e., 30.48 centimeters) different, with an increment of two inches. Other embodiments of the invention could use other dimensional increments besides 11 or 12 inches, particularly in places using the metric system of measurement.

One embodiment of the invention provides an improved sizing scheme to indicate waist and hip measurements. In one embodiment of the invention, a "0.1" indicates an increase of hip size to the next even number (e.g., from 8 to 10, or 10 to 12, etc.). This is because in women's clothing, at least in the U.S., hip sizes go up in increments to the next even number. However, for some individuals this may not be enough range in adjustment. Therefore, in one embodiment, a "0.2" indicates an increase of hip size by two sizes (e.g., increasing from 8 to 12, or 12 to 16, etc.).

Other character indicators besides "0.1" or "0.2" can be used in alternative embodiments of the invention, such as "a" ".a" "b" ".b" "+" and "++" or other equivalent characters. Other character indicators besides "." can be used in alternative embodiments of the invention, such "," "–" ";" "/" "#" and "*" or other equivalent characters. In alternative embodiments of the invention, the sizing chart can have each size displayed in other locations in proximity to the intersection of the waist size and hip size.

FIG. 1 illustrates a sizing chart for clothing with an increment to the next larger even number on the hip size, in accordance with one embodiment of the invention. Referring to FIG. 1 in detail, the sizing chart has a series of waist sizes (in numbers and/or in inches) on the horizontal axis 104 of the sizing chart, and a series of hip sizes (in numbers and/or in inches) on the vertical axis 106 of the chart. The size number 108 is found at the intersection of horizontal and vertical lines corresponding the waist size and hip size. For example, a "12.1" is shown at the intersection of waist size 12 and hip size 14. An alternative embodiment of the invention has the series of waist sizes on the vertical axis 106 and a series of hip sizes on the horizontal axis 104.

Figure 2:
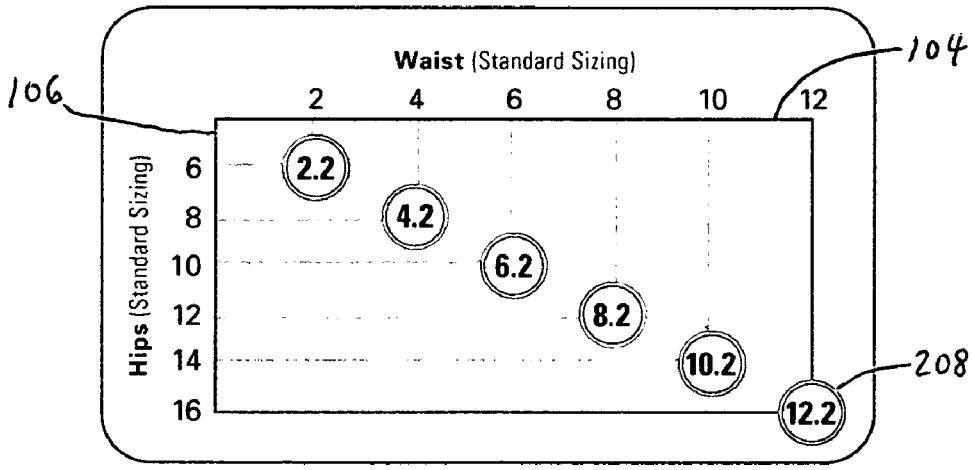
FIG. 2 illustrates a sizing chart for clothing with an increment of two sizes between the hip sizes, in accordance with one embodiment of the invention.

FIG. 2 illustrates a sizing chart for clothing with an increment of two sizes between the hip sizes, in accordance with one embodiment of the invention. Referring to FIG. 2 in detail, the sizing chart has a series of waist sizes (in numbers and/or in inches) on the horizontal axis 104 of the sizing chart, and a series of hip sizes (in numbers and/or in inches) on the vertical axis 106 of the chart. The size number 208 is found at the intersection of horizontal and vertical lines corresponding the waist size and hip size. For example, a "12.2" is shown at the intersection waist size 12 and hip size 16. An alternative embodiment of the invention has the series of waist sizes on the vertical axis 106 and a series of hip sizes on the horizontal axis 104.

Figure 3:
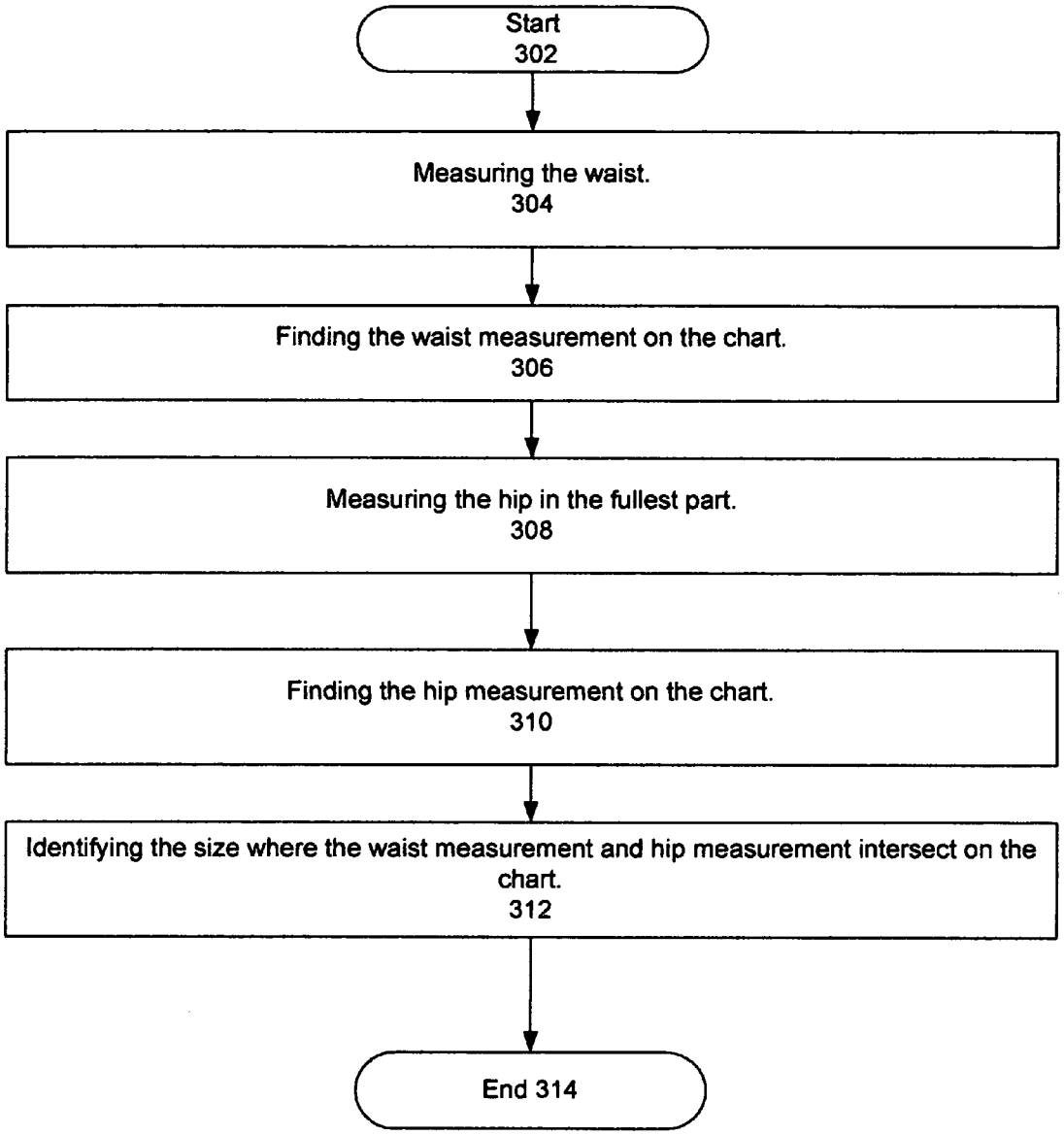
FIG. 3 illustrates a flowchart for a method of using a sizing chart, in accordance with one embodiment of the invention.

FIG. 3 illustrates a flowchart for a method of using a sizing chart, in accordance with one embodiment of the invention. The method begins in operation 302. Operation 304 is next and includes measuring the waist. Operation 306 is next and includes finding the waist measurement on the sizing chart. Operation 308 is next and includes measuring the hip in the fullest part. Operation 310 is next and includes finding the hip measurement on the sizing chart. Operation 312 is next and includes identifying the final size where the waist measurement and the hip measurement intersect on the sizing chart. The method ends in operation 314.

Figure 4:
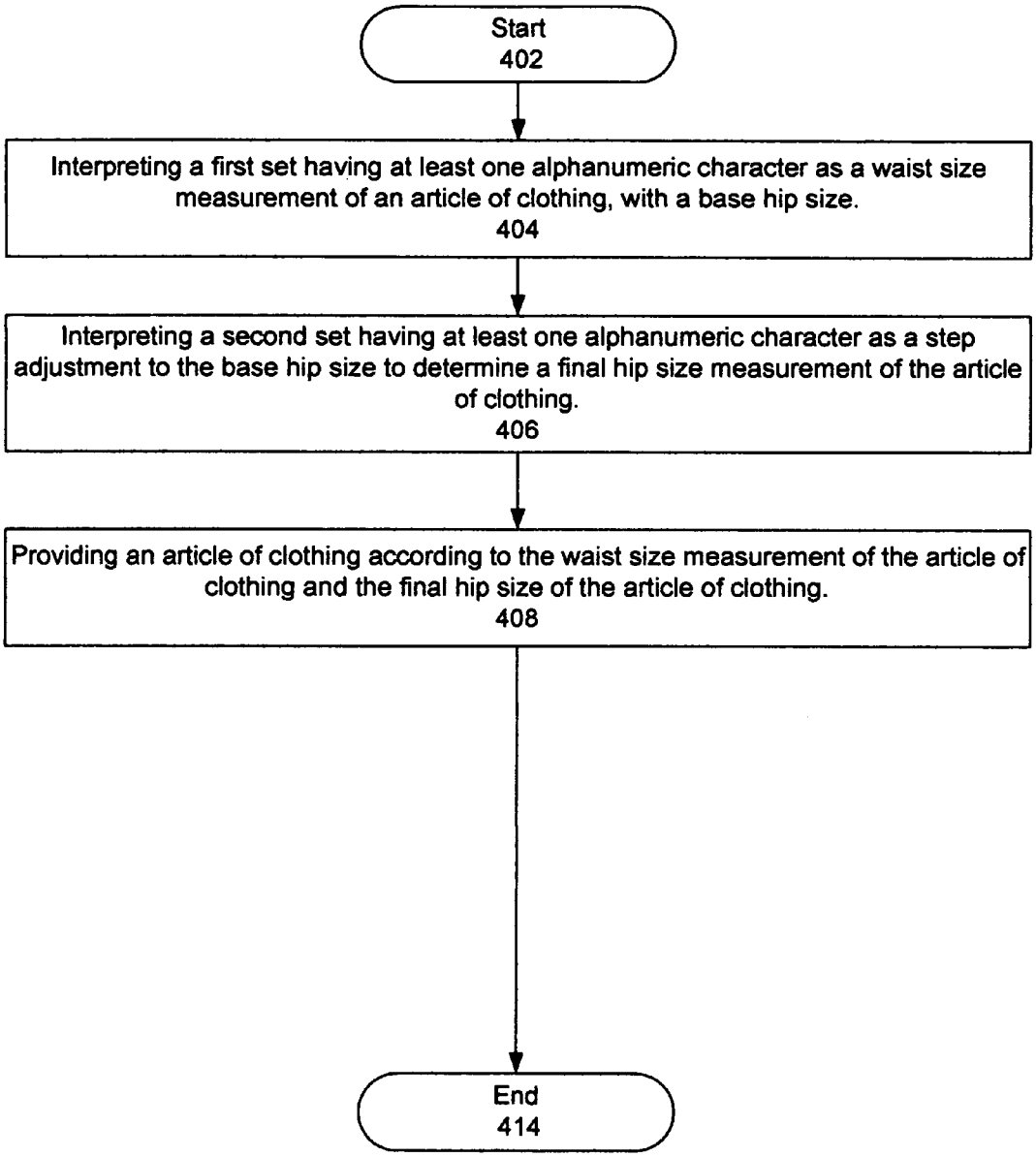
FIG. 4 illustrates a flowchart for a method of providing an article of clothing after receiving the size determined from the sizing chart, in accordance with one embodiment of the invention.

FIG. 4 illustrates a flowchart for a method of providing an article of clothing after receiving the size alphanumeric characters determined from the sizing chart, in accordance with one embodiment of the invention. The method begins in operation 402. Operation 404 is next and includes interpreting a first set having at least one alphanumeric character as the waist size measurement of the article of clothing, with a base hip size. Operation 406 is next and includes interpreting a second set having at least one alphanumeric character as the step adjustment to the base hip size to determine the final hip size measurement of the article of clothing. Operation 408 is next and includes providing an article of clothing according to the waist size measurement of the article of clothing and the final hip size of the article of clothing. The method ends in operation 414. In alternative embodiments of the invention, other characters are used as substitutes for the first set having at least one alphanumeric character and the second set having at least one alphanumeric character disclosed above.

An alternative embodiment of the invention provides an improved sizing scheme to indicate waist and bust measurements. In one embodiment of the invention, a "0.1" indicates an increase of bust size to the next higher size. However, for some individuals this may not be enough range in adjustment. Therefore, in one embodiment, a "0.2" indicates an increase of bust size by two sizes.

Figure 5:
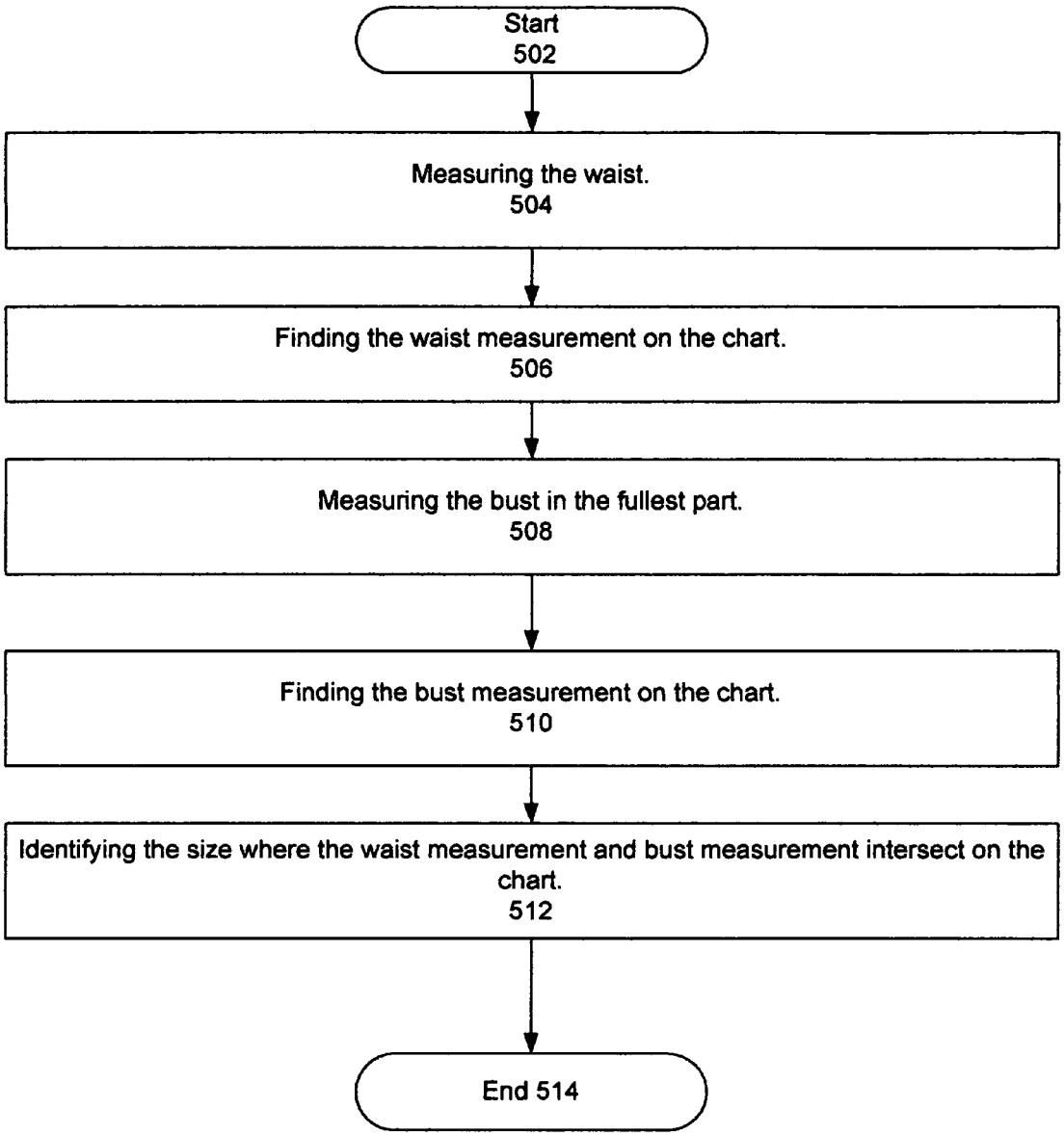
FIG. 5 illustrates a flowchart for a method of using a sizing chart, in accordance with an alternative embodiment of the invention.

FIG. 5 illustrates a flowchart for a method of using a sizing chart, in accordance with an alternative embodiment of the invention. The method begins in operation 502. Operation 504 is next and includes measuring the waist. Operation 506 is next and includes finding the waist measurement on the sizing chart. Operation 508 is next and includes measuring the bust in the fullest part. Operation 510 is next and includes finding the bust measurement on the sizing chart. Operation 512 is next and includes identifying the final size where the waist measurement and the bust measurement intersect on the sizing chart. The method ends in operation 514.

Figure 6:
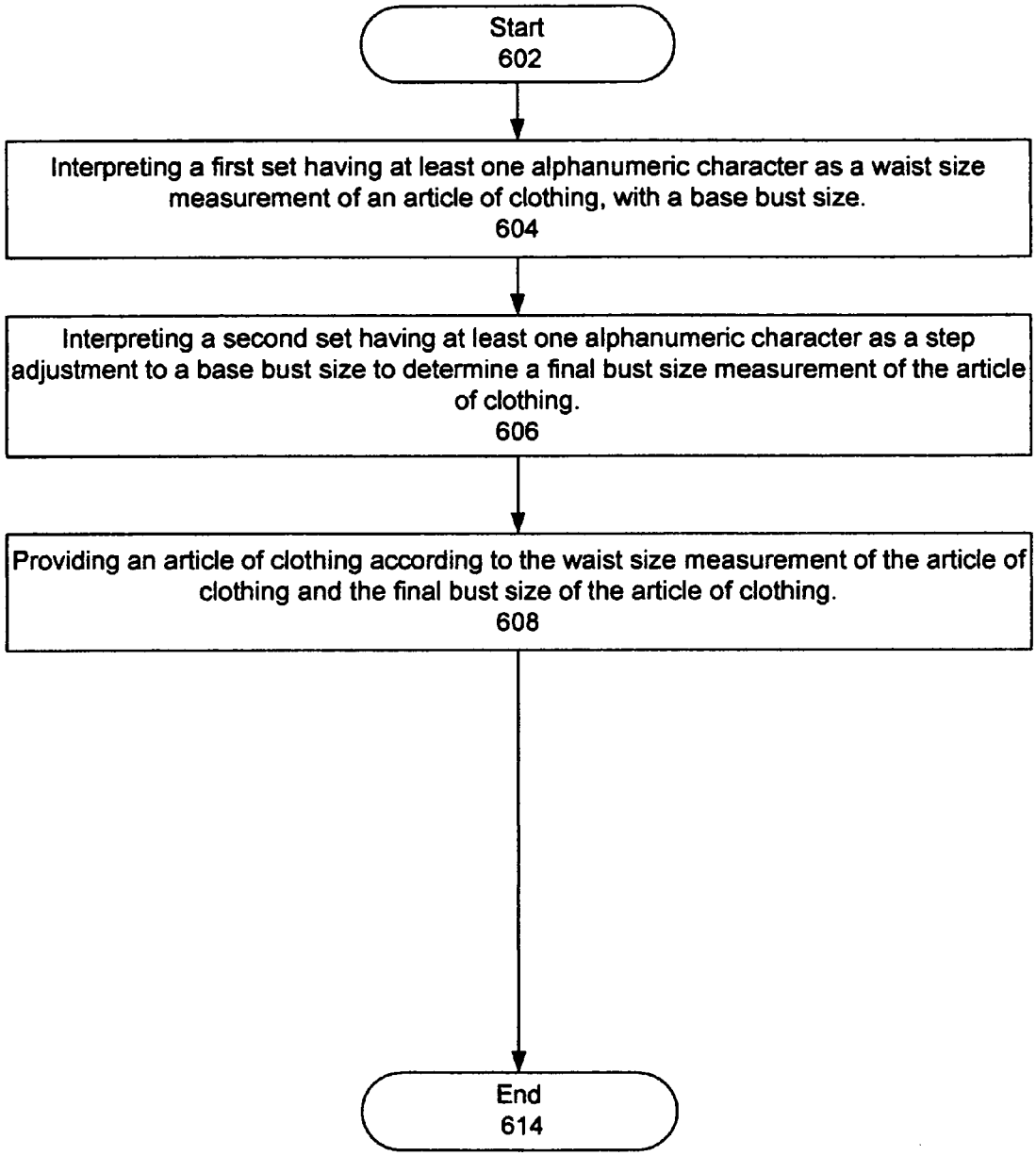
FIG. 6 illustrates a flowchart for a method of providing an article of clothing after receiving the size determined from the sizing chart, in accordance with an alternative embodiment of the invention.

FIG. 6 illustrates a flowchart for a method of providing an article of clothing after receiving the size alphanumeric characters determined from the sizing chart, in accordance with an alternative embodiment of the invention. The method begins in operation 602. Operation 604 is next and includes interpreting a first set having at least one alphanumeric character as the waist size measurement of the article of clothing, with a base bust size. Operation 606 is next and includes interpreting a second set having at least one alphanumeric character as the step adjustment to the base bust size to determine the final bust size measurement of the article of clothing. Operation 608 is next and includes providing an article of clothing according to the waist size measurement of the article of clothing and the final bust size of the article of clothing. The method ends in operation 614. In alternative embodiments of the invention, other characters are used as substitutes for the first set having at least one alphanumeric character and the second set having at least one alphanumeric character disclosed above.

An alternative embodiment of the invention provides an improved sizing scheme to indicate neck and chest measurements. In one embodiment of the invention, a "0.1" indicates an increase of chest size to the next higher size. However, for some individuals this may not be enough range in adjustment. Therefore, in one embodiment, a "0.2" indicates an increase of chest size by two sizes.

Figure 7:
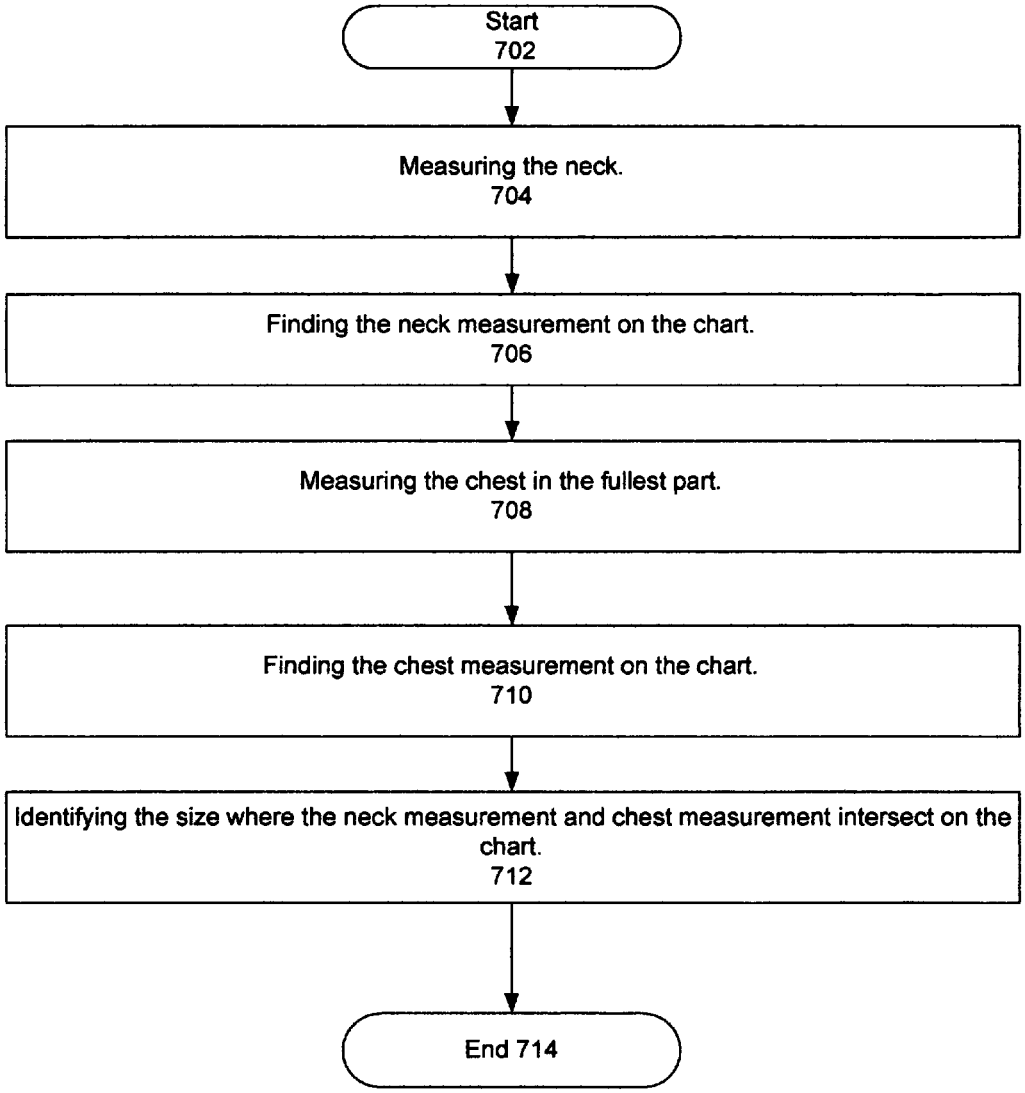
FIG. 7 illustrates a flowchart for a method of using a sizing chart, in accordance with an alternative embodiment of the invention.

FIG. 7 illustrates a flowchart for a method of using a sizing chart, in accordance with an alternative embodiment of the invention. The method begins in operation 702. Operation 704 is next and includes measuring the neck. Operation 706 is next and includes finding the neck measurement on the sizing chart. Operation 708 is next and includes measuring the chest in the fullest part. Operation 710 is next and includes finding the chest measurement on the sizing chart. Operation 712 is next and includes identifying the final size where the neck measurement and the chest measurement intersect on the sizing chart. The method ends in operation 714.

Figure 8:
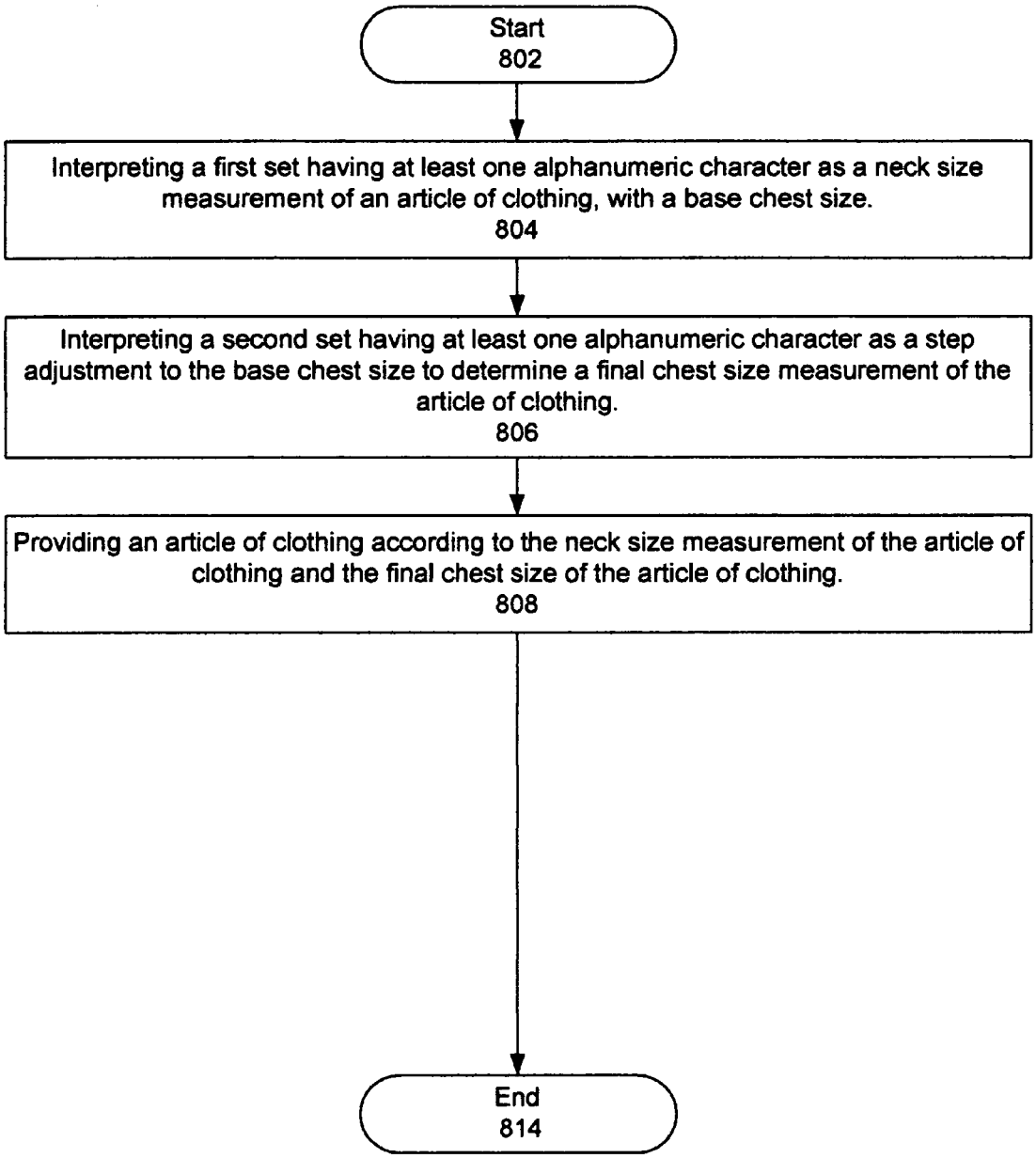
FIG. 8 illustrates a flowchart for a method of providing an article of clothing after receiving the size determined from the sizing chart, in accordance with an alternative embodiment of the invention.

FIG. 8 illustrates a flowchart for a method of providing an article of clothing after receiving the size alphanumeric characters determined from the sizing chart, in accordance with an alternative embodiment of the invention. The method begins in operation 802. Operation 804 is next and includes interpreting a first set having at least one alphanumeric character as the neck size measurement of the article of clothing, with a base chest size. Operation 806 is next and includes interpreting a second set having at least one alphanumeric character as the step adjustment to the base chest size to determine the final chest size measurement of the article of clothing. Operation 808 is next and includes providing an article of clothing according to the neck size measurement of the article of clothing and the final chest size of the article of clothing. The method ends in operation 814. In alternative embodiments of the invention, other characters are used as substitutes for the first set having at least one alphanumeric character and the second set having at least one alphanumeric character disclosed above.

Other embodiments of the invention are possible. For example, the incremental difference in hip measurement can be based on an increment other than 1 or 2 inches (i.e., 2.54 or 5.08 centimeters) over the industry standard 10 inch (i.e., 25.4 centimeters) difference between the hip size and the waist size.

Figure 9:
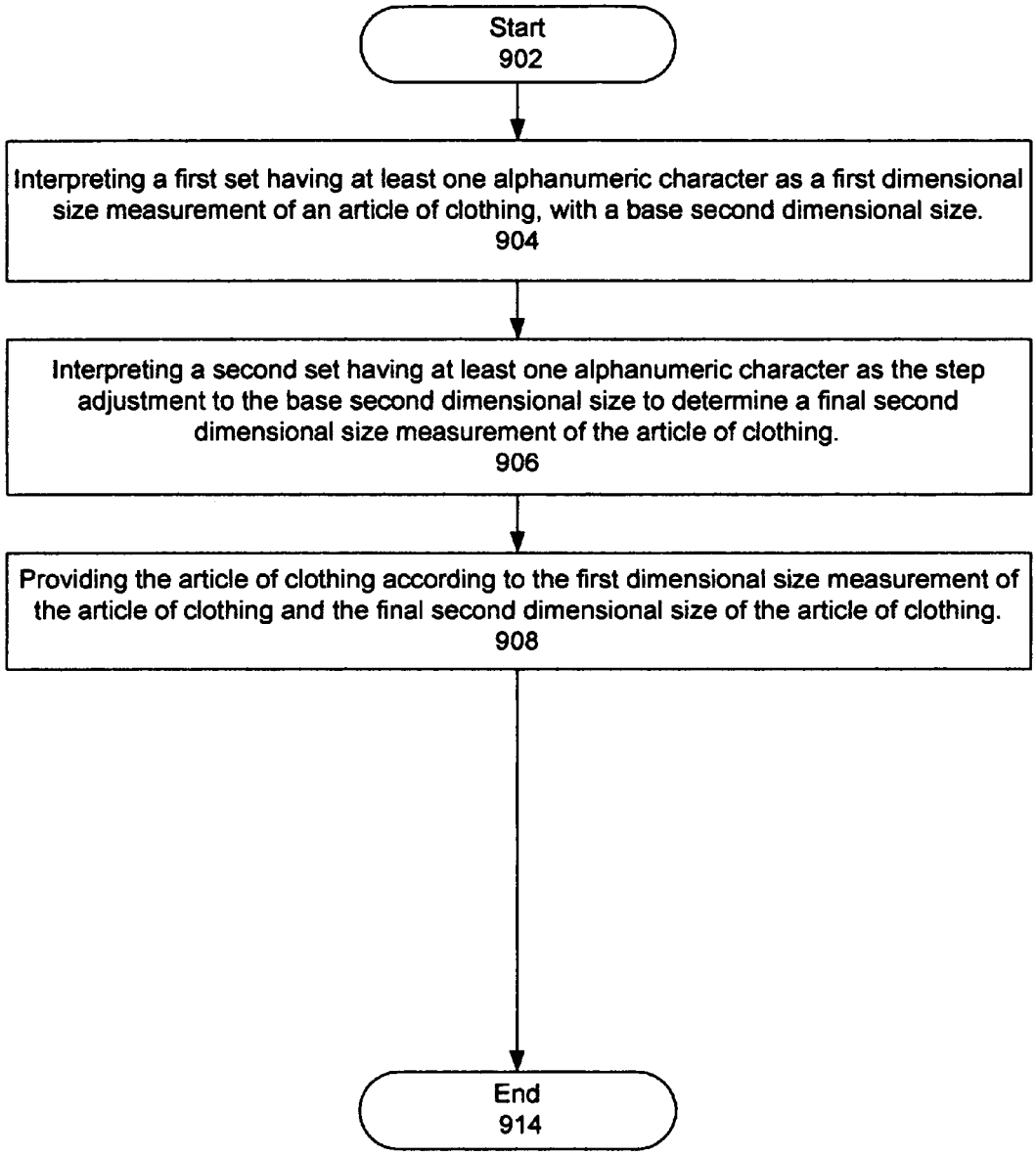
FIG. 9 illustrates a flowchart for a method of providing an article of clothing after receiving the size determined from the sizing chart, in accordance with an alternative embodiment of the invention.

FIG. 9 illustrates a flowchart for a method of providing an article of clothing after receiving the size alphanumeric characters determined from the sizing chart, in accordance with an alternative embodiment of the invention. The method begins in operation 902. Operation 904 is next and includes interpreting a first set having at least one alphanumeric character as a first dimensional size measurement of the article of clothing, with a base second dimensional size. Operation 906 is next and includes interpreting a second set having at least one alphanumeric character as the step adjustment to the base second dimensional size to determine the final second dimensional size measurement of the article of clothing. Operation 908 is next and includes providing an article of clothing according to the first size measurement of the article of clothing and the final second dimensional size of the article of clothing. The method ends in operation 914.

Several embodiments of the invention are possible. The phrase "in one embodiment" used in the specification can refer to a new embodiment, a different embodiment disclosed elsewhere in the application, or the same embodiment disclosed earlier in the application. The exemplary embodiments described herein are for purposes of illustration and are not intended to be limiting. Therefore, those skilled in the art will recognize that other embodiments could be practiced without departing from the scope and spirit of the claims set forth below.

What is claimed is:

1. A method of providing an article of clothing after receiving the size alphanumeric characters determined from a sizing chart, comprising:

interpreting a first set having at least one alphanumeric character as a first dimensional size measurement of an article of clothing, with a base second dimensional size;

interpreting a second set having at least one alphanumeric character as the step adjustment to the base second dimensional size to determine a final second dimensional size measurement of the article of clothing; and providing the article of clothing according to the first dimensional size measurement of the article of clothing and the final second dimensional size measurement of the article of clothing.

2. The method of claim 1, wherein the first dimensional size measurement corresponds to the waist size of the article of clothing.

3. The method of claim 1, wherein the second dimensional size measurement corresponds to the hip size of the article of clothing.

4. The method of claim 1, wherein the second dimensional size measurement corresponds to a bust size of the article of clothing.

5. The method of claim 1, wherein the first dimensional size measurement corresponds to a neck size of the article of clothing.

6. The method of claim 1, wherein the second dimensional size measurement corresponds to a chest size of the article of clothing.

7. The method of claim 1, wherein a unit increment in the second set having at least one alphanumeric character indicates an increase of two sizes as the step adjustment to the base hip size of the article of clothing.

8. The method of claim 1, wherein a unit increment in the second set having at least one alphanumeric character indicates an increase of four sizes as the step adjustment to the base hip size of the article of clothing.

9. The method of claim 1, further comprising:

fabricating a tag indicating the first set having at least one alphanumeric character and the second set having at least one alphanumeric character, separated by a character, to indicate two dimensional sizes of the article of clothing.

10. A method of providing an article of clothing after receiving the size determined from a sizing chart, comprising:

interpreting a first set having at least one alphanumeric character as a waist size measurement of an article of clothing, with a base hip size;

interpreting a second set having at least one alphanumeric character as the step adjustment to the base hip size to determine a final hip size measurement of the article of clothing; and providing the article of clothing according to the waist size measurement of the article of clothing and the final hip size of the article of clothing.

11. The method of claim 10, wherein a unit increment in the second set having at least one alphanumeric character indicates an increase of two sizes as the step adjustment to the base hip size of the article of clothing.

12. The method of claim 10, wherein a unit increment in the second set having at least one alphanumeric character indicates an increase of four sizes as the step adjustment to the base hip size of the article of clothing.

13. A sizing chart for an article of clothing, comprising:

a first set having at least one alphanumeric character corresponding to a first dimensional size of an article of clothing;

a second set having at least one alphanumeric character corresponding to a second dimensional size of the article of clothing; and an indication of a final size of the article of clothing in proximity to an intersection of the first set having at least one alphanumeric character and the second set having at least one alphanumeric character.

14. The sizing chart of claim 13, wherein the first set having at least one alphanumeric character corresponding to the first dimensional size corresponds to a waist size of the article of clothing.

15. The sizing chart of claim 13, wherein the second set having at least one alphanumeric character corresponding to the second dimensional size corresponds to a final hip size of the article of clothing.

16. The sizing chart of claim 13, wherein the first set having at least one alphanumeric character corresponds to a waist size of the article of clothing, and the second set having at least one alphanumeric character corresponds to a hip size adjustment of the article of clothing.

17. The sizing chart of claim 13, wherein the first set having at least one alphanumeric character corresponds to a waist size of the article of clothing, and the second set having at least one alphanumeric character corresponds to a bust size of the article of clothing.

18. The sizing chart of claim 13, wherein the first set having at least one alphanumeric character corresponds to a neck size of the article of clothing, and the second set having at least one alphanumeric character corresponds to a chest size of the article of clothing.

19. The sizing chart of claim 13, wherein the first set having at least one alphanumeric character corresponds to a waist size of the article of clothing, and the second set having at least one alphanumeric character indicate an increase of two hip sizes of the article of clothing.

20. A sizing chart for an article of clothing, comprising:

a first set having at least one alphanumeric character corresponding to a waist dimensional size of an article of clothing;

a second set having at least one alphanumeric character corresponding to a hip dimensional size of the article of clothing; and an indication of a waist dimensional size and a final hip dimensional size of the article of clothing in proximity to an intersection of the first set having at least one alphanumeric character and the second set having at least one alphanumeric character.

* * * * *